US007606704B2

(12) United States Patent
Gray et al.

(10) Patent No.: US 7,606,704 B2
(45) Date of Patent: Oct. 20, 2009

(54) QUALITY ASSESSMENT TOOL

(75) Inventors: Philip Gray, Ipswich (GB); Ludovic Malfait, Ipswich (GB)

(73) Assignee: Psytechnics Limited, Ipswich (GB)

( * ) Notice: Subject to any disclaimer, the term of this patent is extended or adjusted under 35 U.S.C. 154(b) by 621 days.

(21) Appl. No.: 10/757,365

(22) Filed: Jan. 14, 2004

(65) Prior Publication Data

US 2004/0186715 A1 Sep. 23, 2004

(30) Foreign Application Priority Data

Jan. 18, 2003 (EP) ..... 03250333

(51) Int. Cl.
*G10L 21/00* (2006.01)
*G10L 21/02* (2006.01)

(52) U.S. Cl. ..... 704/226; 704/228

(58) Field of Classification Search ..... 704/228
See application file for complete search history.

(56) References Cited

U.S. PATENT DOCUMENTS 5,794,188 A * 8/1998 Hollier ..... 704/228
6,446,038 B1 * 9/2002 Bayya et al. ..... 704/232
6,609,092 B1 * 8/2003 Ghitza et al. ..... 704/226
7,024,362 B2 * 4/2006 Chu et al. ..... 704/260
7,162,011 B2 * 1/2007 Kolligs et al. ..... 379/1.04

FOREIGN PATENT DOCUMENTS

WO WO 01/35393 A1 5/2001

* cited by examiner

*Primary Examiner*—David R Hudspeth
*Assistant Examiner*—Samuel G Neway
(74) *Attorney, Agent, or Firm*—Burr & Brown

(57) ABSTRACT

A non-intrusive speech quality assessment system. A method and apparatus for training a quality assessment tool in which a database comprising a plurality of samples, each with an associated mean opinion score, is divided into a plurality of distortion sets of samples according to a distortion criterion; and a distortion specific assessment handler for each distortion set is trained, such that a fit between a distortion specific quality measure generated from a distortion specific plurality of parameters for a sample and the mean opinion score associated with said sample is optimised. A method and apparatus for assessing speech quality in a telecommunications network in which a dominant distortion type is determined for a sample; a distortion specific plurality of parameters are combined to provide a distortion specific quality measure for each sample; and a quality measure is generated in dependence upon the distortion specific quality measure.

16 Claims, 5 Drawing Sheets

QUALITY ASSESSMENT TOOL

This application claims the benefit of European Application 03250333.6, filed Jan. 18, 2003, the entirety of which is incorporated herein by reference.

This invention relates to a non-intrusive speech quality assessment system.

Signals carried over telecommunications links can undergo considerable transformations, such as digitisation, encryption and modulation. They can also be distorted due to the effects of lossy compression and transmission errors.

Objective processes for the purpose of measuring the quality of a signal are currently under development and are of application in equipment development, equipment testing, and evaluation of system performance.

Some automated systems require a known (reference) signal to be played through a distorting system (the communications network or other system under test) to derive a degraded signal, which is compared with an undistorted version of the reference signal. Such systems are known as "intrusive" quality assessment systems, because whilst the test is carried out the channel under test cannot, in general, carry live traffic.

Conversely, non-intrusive quality assessment systems are systems which can be used whilst live traffic is carried by the channel, without the need for test calls.

Non-intrusive testing is required because for some testing it is not possible to make test calls. This could be because the call termination points are geographically diverse or unknown. It could also be that the cost of capacity is particularly high on the route under test. Whereas, a non-intrusive monitoring application can run all the time on the live calls to give a meaningful measurement of performance.

A known non-intrusive quality assessment system uses a database of distorted samples which has been assessed by panels of human listeners to provide a Mean Opinion Score (MOS).

MOSs are generated by subjective tests which aim to find the average user's perception of a system's speech quality by asking a panel of listeners a directed question and providing a limited response choice. For example, to determine listening quality users are asked to rate "the quality of the speech" on a five-point scale from Bad to Excellent. The MOS, is calculated for a particular condition by averaging the ratings of all listeners.

In order to train the quality assessment system each sample is parameterised and a combination of the parameters is determined which provides the best prediction of the MOSs indicted by the human listeners. International Patent Application number WO 01/35393 describes one method for paramterising speech samples for use in a non-intrusive quality assessment system.

However, one problem with such a known system is that a combination of a single set of parameters for all samples is not effective for providing an accurate prediction when there are many different types of distortion which can occur.

The inventors have discovered that for most samples a particular type of distortion predominates—for example, low signal to noise ratio, parts of the signal are missing, coding distortions, abnormal noise characteristics, or acoustic distortions are present.

According to the invention there is provided a method of training a quality assessment tool comprising the steps of dividing a database comprising a plurality of samples, each with an associated mean opinion score into a plurality of distortion sets of samples according to a distortion criterion; and training a distortion specific assessment handler for each distortion set, such that a fit between a distortion specific quality measure generated from a distortion specific plurality of parameters for a sample and the mean opinion score associated with said sample is optimised.

The quality assessment tool can be further improved if non-distortion specific parameters are combined with the distortion specific quality measure as a further parameter and the tool is then trained to optimise a fit between these parameters and the mean opinion scores.

Therefore, the method advantageously further comprises the steps of training the quality assessment tool, such that a fit between a quality measure generated from a non-distortion specific plurality of parameters together with a distortion specific quality measure for a sample, and the mean opinion score associated with said sample, is optimised.

According to a second aspect of the invention there is also provided a method of assessing speech quality in a telecommunications network comprising the steps of determining a dominant distortion type for a sample; combining a plurality of parameters specific to said dominant distortion type to provide a distortion specific quality measure for each sample; and generating a quality measure in dependence upon the distortion specific quality measure.

Preferably the generating step comprises the sub step of combining a non-distortion specific plurality of parameters with said distortion specific quality measure to provide said quality measure.

According to a third aspect of the invention there is provided an apparatus for assessing speech quality in a telecommunications network comprising means for determining a dominant distortion type for a sample; means for combining a distortion specific plurality of parameters to provide a distortion specific quality measure for each sample; and means for generating a quality measure in dependence upon the distortion specific quality measure.

In a preferred embodiment the generating means comprises means for combining a non-distortion specific plurality of parameters with said distortion specific quality measure to provide said quality measure.

According to a further aspect of the invention there is provided an apparatus for training a quality assessment tool comprising means for dividing a database comprising a plurality of samples, each with an associated mean opinion score into a plurality of distortion sets of samples according to a distortion criterion; and means for training a distortion specific assessment handler for each distortion set, such that a fit between a distortion specific quality measure generated from a distortion specific plurality of parameters for a sample and the mean opinion score associated with said sample is optimised.

Preferably the apparatus further comprises means for training the quality assessment tool, such that a fit between a quality measure generated from a non-distortion specific plurality of parameters together with a distortion specific quality measure for a sample, and the mean opinion score associated with said sample, is optimised.

Preferably the samples represent speech transmitted over a telecommunications network, and in which the quality measure is representative of the quality of the speech perceived by an average user.

Embodiments of the invention will now be described, by way of example only, with reference to the accompanying drawings, in which.

Figure 1:
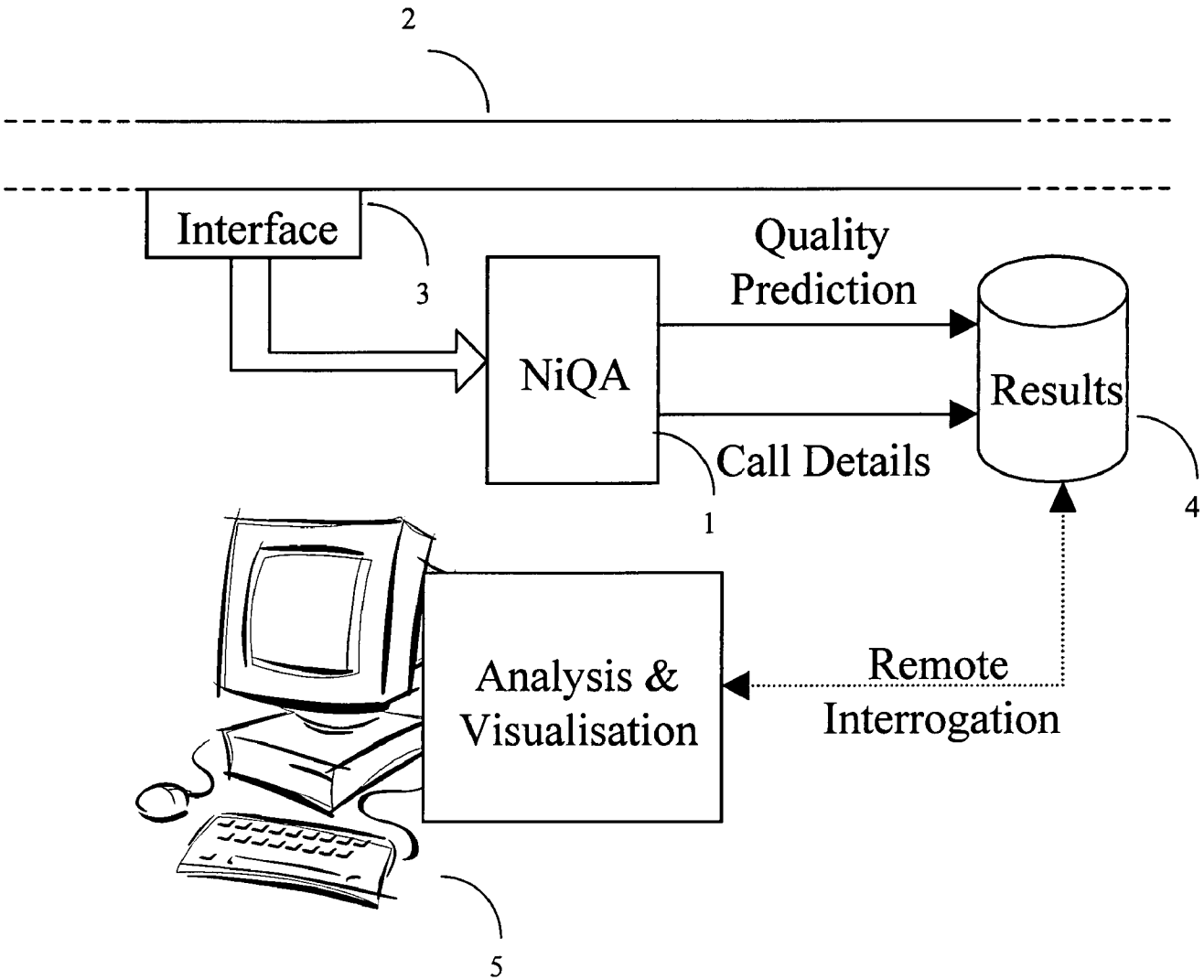
FIG. 1 is a schematic illustration of a non-intrusive quality assessment system.

Referring to FIG. 1, a non-intrusive quality assessment system 1 is connected to a communications channel 2 via an interface 3. The interface 3 provides any data conversion required between the monitored data and the quality assessment system 1. A data signal is analysed by the quality assessment system, as will be described later and the resulting quality prediction is stored in a database 4. Details relating to data signals which have been analysed are also stored for later reference. Further data signals are analysed and the quality prediction is updated so that over a period of time the quality prediction relates to a plurality of analysed data signals.

The database 4 may store quality prediction results from a plurality of different intercept points. The database 4 may be remotely interrogated by a user via a user terminal 5, which provides analysis and visualisation of quality prediction results stored in the database 4.

Figure 2:
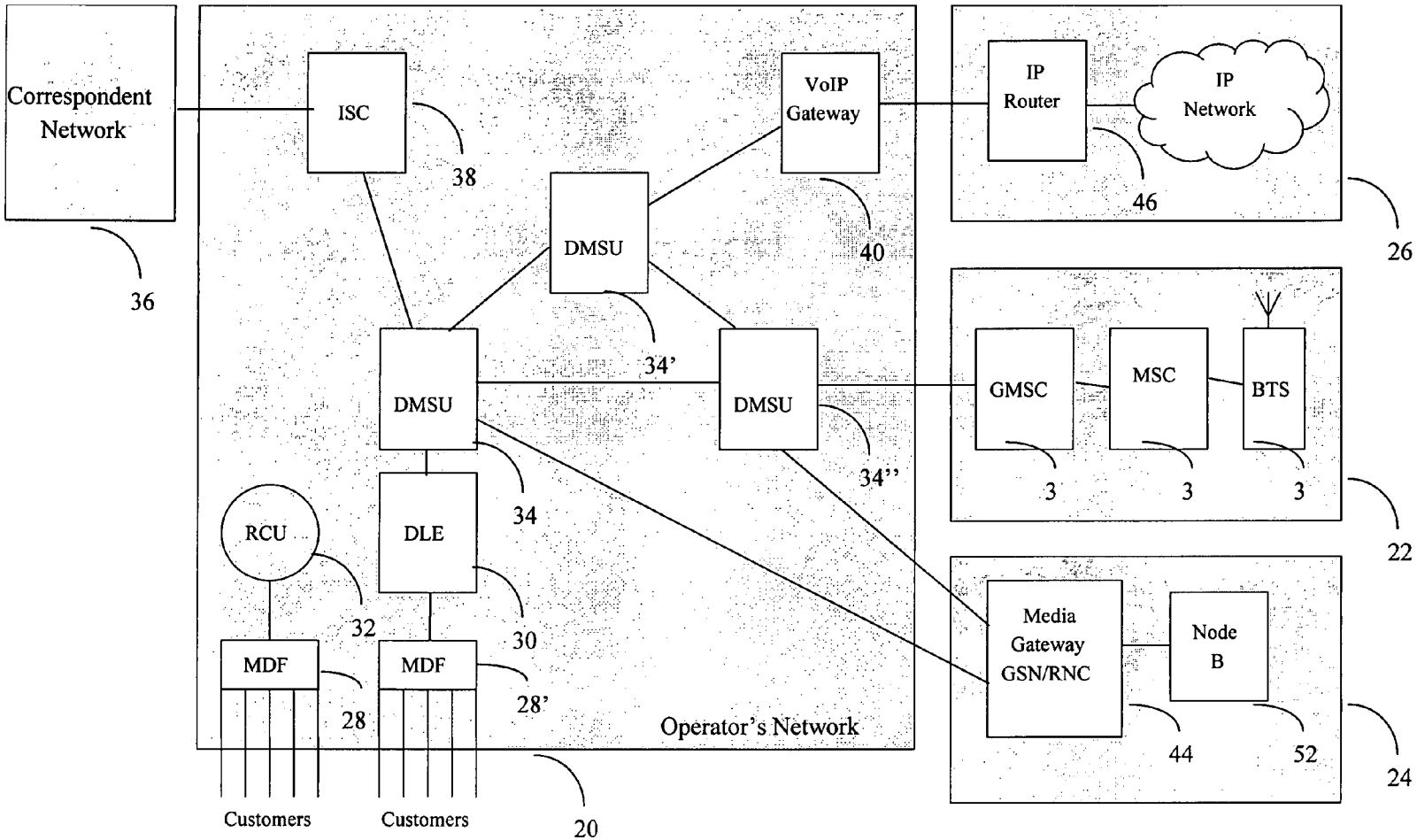
FIG. 2 is a schematic illustration showing possible non-intrusive monitoring points in a network.

FIG. 2 is a block diagram of an illustrative telecommunications network showing possible intercept points where non-intrusive quality assessment may be employed.

The telecommunication network shown in FIG. 2 comprises an operator's network 20 which is connected to a Global System for Mobile communications (GSM) mobile network 22, a third generation (3G) mobile network 24, and an Internet Protocol (IP) network 26. The operator's network 20 is accessed by customers via main distribution frames 28, 28' which are connected to a digital local exchange (DLE) 30 possibly via a remote concentrator unit (RCU) 32.

Calls are routed through digital multiplexing switching units (DMSU) 34, 34,', 34" and may be routed to a correspondent network 36 via an international switching centre (ISC) 38, to the IP network 26 via a voice over IP gateway 40, to the GSM network 22 via a Gateway Mobile Switching Centre (GMSC) 42 or to the 3G network 24 via a gateway 44. The IP network 26 comprises a plurality of IP routers of which one IP router 46 is shown. The GSM network 22 comprises a plurality of mobile switching centres (MSCs), of which one MSC 48 is shown, which are connected to a plurality of base transceiver stations (BTSs), of which one BTS 50 is shown. The 3G network 24 comprises a plurality of nodes, of which one node 52 is shown.

Non intrusive quality assessment may be performed, for example, at the following points:

At the DLE 30 incoming calls to specific customer, output from an exchange may be assessed.

At the DMSUs 34, 34', 34", links between DMSUs and interconnects with other operators may be assessed.

At the ISC 38 the international link may be assessed.

At the Voice over IP gateway 40 the interface with an IP network may be assessed.

At the MSC 48 calls to and from the mobile network may be assessed.

At the IP router 46 calls to and from the IP network may be assessed.

At the media gateway 44 calls to and from the 3G network may be assessed.

A variety of testing regimes and configurations can be used to suit a particular application, providing quality measures for selections of calls based upon the user's requirements. These could include different testing schedules and route selections. With multiple assessment points in a network, it is possible to make comparisons of results between assessment points. This allows the performance of specific links or network subsystems to be monitored. Reductions in the quality perceived by customers can then be attributed to specific circumstances or faults.

The data, stored in the database 4, can be used for a number of applications such as:—

Figure 3:
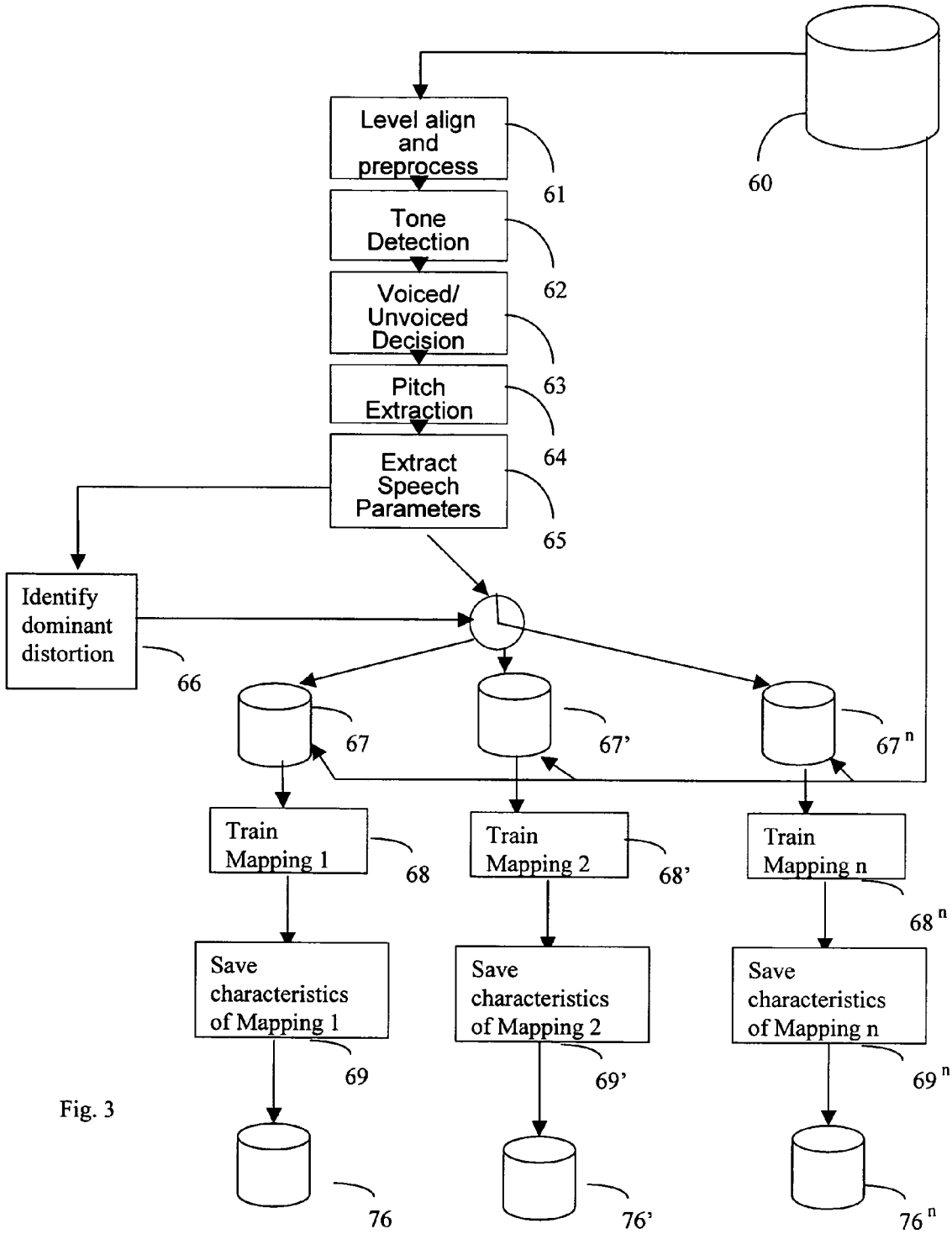
FIG. 3 is a flow chart illustrating training a quality assessment tool according to the present invention.

Network Health Checks
Network Optimisation
Equipment Trials/Commissioning
Realtime Routing
Interoperability Agreement Monitoring
Network Trouble Shooting
Alarm Generation on Routes
Mobile Radio Planning/Optimisation Referring now to FIG. 3, a method of training a non-intrusive quality assessment system according to the present invention will now be described. It will be understood that this method may be carried out by software controlling a general purpose computer.

A database 60 contains distorted speech samples containing a diverse range of conditions and technologies. These have been assessed by panels of human listeners to provide a MOS, in a known manner. Each speech sample therefore has an associated MOS derived from subjective tests.

At 61 each sample is pre-processed to normalise the signal level and take account of any filtering effects of the network via which the speech sample was collected. The speech sample is filtered, level aligned and any DC offset is removed. The amount of amplification or attenuation applied is stored for later use.

At step 62 tone detection is performed for each sample to determine whether the sample is speech, data, or if it contains DTMF or musical tones. If it is determined that the sample is not speech then the sample is discarded, and is not used for training the quality assessment tool.

At step 63 each speech sample is annotated to indicate periods of speech activity and silence/noise. This is achieved by use of a Voice Activity Detector (VAD) together with a voiced/unvoiced speech discriminator.

At step 64 each speech sample is annotated to indicate positions of the pitch cycles using a temporal/spectral pitch extraction method. This allows parameters to be extracted on a pitch synchronous basis, which helps to provide parameters which are independent of the particular talker. Vocal Tract Descriptors are extracted as part of the speech parameterisation described later and need to be taken from the voiced sections of the speech file. A final pitch cycle identifier is used to provide boundaries for this extraction. A characterisation of the properties of the pitch structure over time is also passed to step 65 to form part of the speech parameters.

The parameterisation step 65 is designed to reduce the amount of data to be processed whilst preserving the information relevant to the distortions present in the speech sample.

In this embodiment of the invention over 300 candidate parameters are calculated including the following:

Noise Level
Signal to Noise Ratio
Average Pitch of Talker
Pitch Variation Descriptors
  Length Variations
  Frame to Frame content variations
Instantaneous Level Fluctuations Vocal Tract Descriptors:

In addition to the above, various descriptions of the vocal tract parameters are calculated. They capture the overall fit of the vocal tract model, instantaneous improbable variations and illegal sequences. Average values and statistics for individual vocal tract model elements over time are also included as base parameters. For example, see International Patent Application Number WO 01/35393.

At step 66 the parameters associated with each sample are processed to identify the dominant distortion which is present in that sample, in this particular embodiment the dominant distortion types used include the following: low signal to noise ratio, missing parts of signal, coding distortion, abnormal noise characteristics, acoustic distortions. This allows the samples of the database 60 to be divided into a plurality of distortion sets 67, 67' . . . 67$^n$ in dependence upon the dominant distortion present in each sample.

The dominant distortion type of a speech sample determines which distortion specific assessment handler mapping will be trained with that speech sample. A mapping 76, 76' . . . 76$^n$ for each distortion handler is trained at one of steps 68, 68' . . . 68$^n$ using the samples in a single distortion set 67, 67' . . . 67$^n$. Once the optimum mapping between the parameters for each speech sample of the distortion set and the MOS associated with each speech sample (provided by the database 60) has been determined for the samples of that distortion set a characterisation of the mapping is saved at one of steps 69, 69' . . . 69$^n$, which includes identification of the particular parameters which resulted in the optimum mapping.

In this embodiment the mapping is a linear mapping between the chosen parameters and MOSs and the optimum mapping is determined using linear regression analysis, such that once each distortion specific assessment handler has been trained at one of steps 68, 68' . . . 68$^n$ the distortion specific mapping 76, 76', 76$^n$ is characterised by a set of parameters used in the particular mapping together with a weight for each parameter.

Once the mappings 76, 76', 76$^n$ for each of the distortion specific assessment handlers have been trained at steps 68, 68' . . . 68$^n$ the overall mapping for the quality assessment tool is trained, as will now be described with reference to FIG. 4.

Samples from the speech database 60 are processed at step 70, which represents steps 61-64 of FIG. 3, as described previously with reference to FIG. 3.

At step 65 the speech samples are parameterised as described previously. At step 66 the dominant distortion type is identified as described previously. Once the dominant distortion type has been identified for a particular sample then the distortion specific assessment handler associated with that distortion type is selected to further process that sample. For example, if distortion handler 72$^n$ is selected the distortion handler 72$^n$ uses the associated previously trained mapping 76$^n$, the characteristics of which were saved at step 69$^n$ (FIG. 3).

The MOS generated by distortion handler 72$^n$ is used along with the speech parameters generated at step 65 for that particular sample to train the quality assessment tool overall mapping at step 73 in a similar manner to training of the distortion specific assessment handlers described earlier. At step 74 the characteristics of the overall mapping 77 are saved for use in the quality assessment tool.

Figure 5:
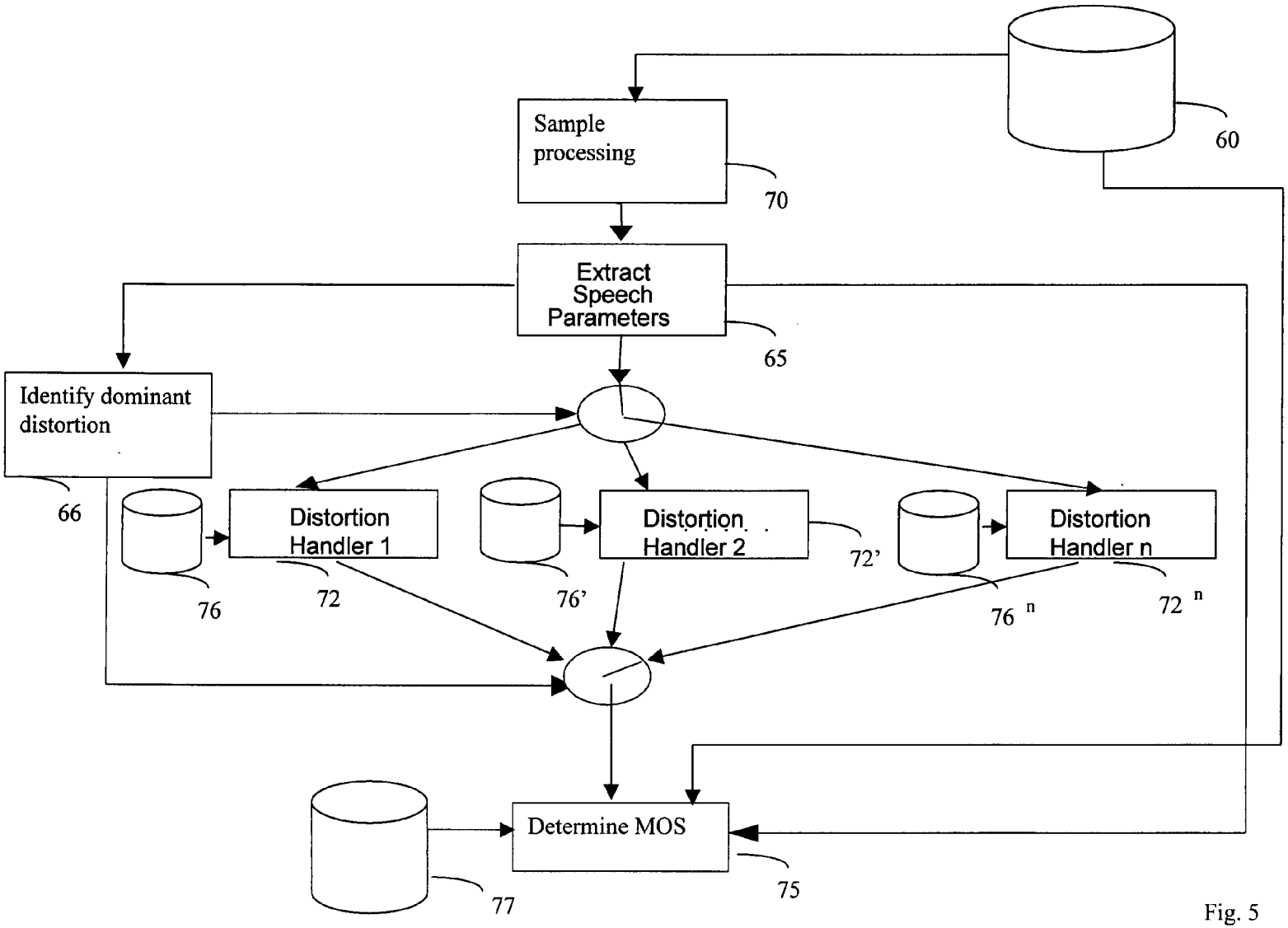
FIG. 5 is a flow chart illustrating the operation of an assessment tool of the present invention.

The operation of the non-intrusive quality assessment tool, once training has been completed, will now be described with reference to FIG. 5.

Figure 4:
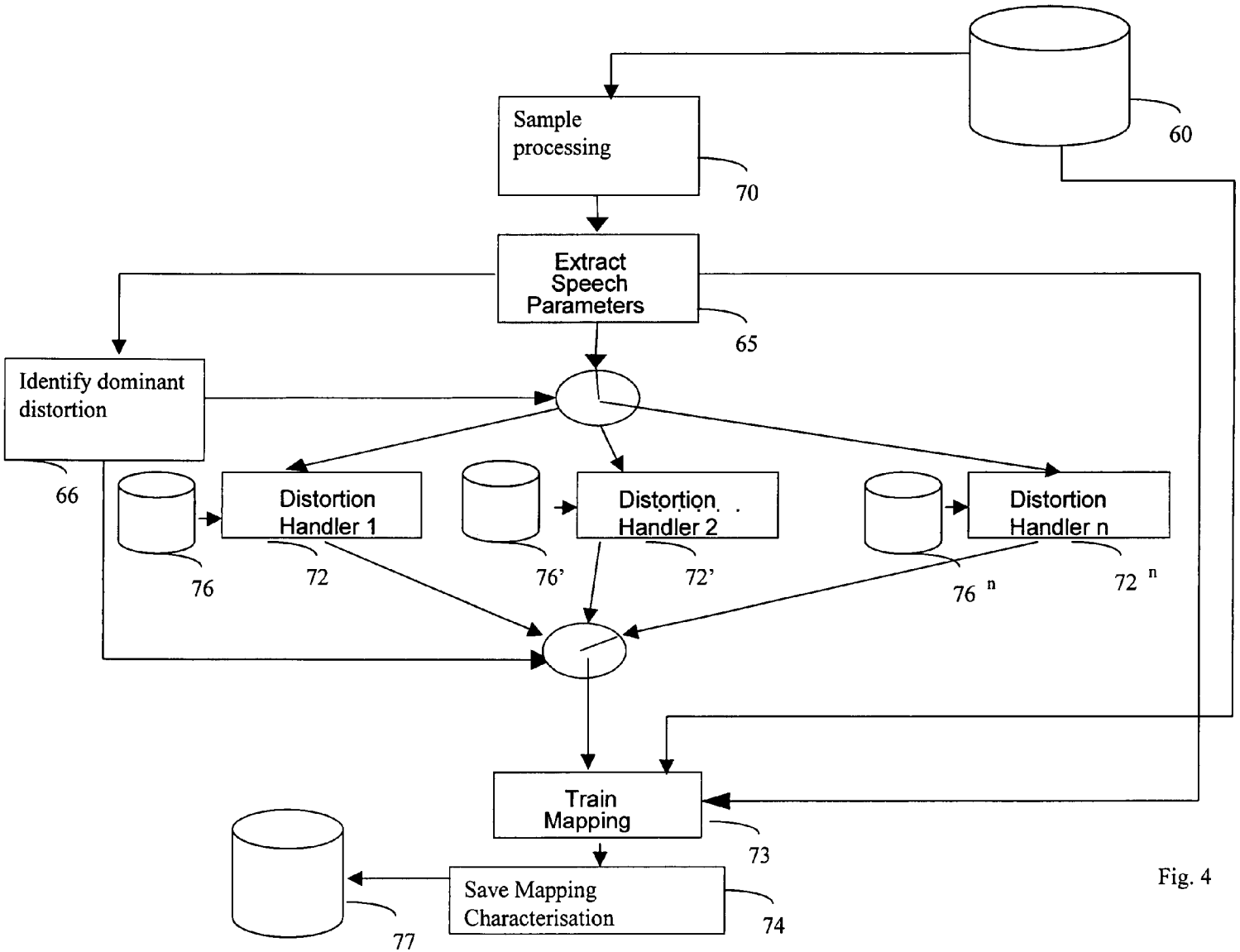
FIG. 4 is a is flow chart further illustrating training a quality assessment tool according to the present invention.

The steps for operation of the quality assessment tool are similar to the steps shown in FIG. 4, which are performed during training of the overall mapping for the quality assessment tool.

However, in this case only one sample is processed at a time and only one distortion specific assessment handler is used. Step 73, train mapping, and step 74, save mapping charaterisation, are replaced by step 75. At step 75 the previously saved mapping characteristics 77 are used to determine the MOS for the sample.

Clearly, it is not necessary to actually calculate parameters for a sample if they are not to be used to select the dominant distortion type, by the selected distortion specific assessment handler or for determining the MOS at step 75. Therefore it may be possible to optimise the method shown in FIG. 5 by only calculating at step 65 the parameters need to identify the dominant distortion type at step 66 or for the overall determination of MOS at step 75. Subsequently, other parameters are calculated only if they are needed by the selected dominant distortion assessment handler.

It will be understood by those skilled in the art that the methods described above may be implemented on a conventional programmable computer, and that a computer program encoding instructions for controlling the programmable computer to perform the above methods may be provided on a computer readable medium.

It will be appreciated that whilst the process above has been described with specific reference to speech signals, the processes are equally applicable to other types of signals, for example video signals.

The invention claimed is:

1. A method of training a quality assessment tool comprising the steps of dividing a database comprising a plurality of samples, each with an associated mean opinion score, into a plurality of distortion sets of samples according to a dominant distortion present in each sample; and training a distortion specific assessment handler for each distortion set, to generate an optimized fit between a distortion specific quality measure generated from a distortion specific plurality of parameters for a sample and the mean opinion score associated with said sample;

generating a quality prediction result based on said optimized fit; and storing the quality prediction result in a computer-readable medium.

2. A method according to claim 1, further comprising the steps of training the quality assessment tool, such that a fit between a quality measure generated from a non-distortion specific plurality of parameters together with a distortion specific quality measure for a sample, and the mean opinion score associated with said sample, is optimized.

3. A method according to claim 1 in which the samples represent speech transmitted over a telecommunications network, and in which the quality measure is representative of the quality of the speech perceived by an average user.

4. A method of assessing speech quality of a sample in a telecommunications network comprising the steps of identifying a first dominant distortion type for the sample, the first dominant distortion type being selected from a plurality of possible distortion types;

selecting a first distortion specific assessment handler in dependence upon said first dominant distortion type from a plurality of distortion specific assessment handlers, each of said plurality of distortion specific assessment handlers being associated with a respective one of said plurality of possible distortion types;

using the first distortion specific assessment handler to combine a plurality of parameters specific to said first dominant distortion type to provide a distortion specific quality measure for the sample;

generating a quality measure in dependence upon the distortion specific quality measure; and storing said quality measure in a computer-readable medium.

5. A method according to claim 4 in which the generating step comprises the sub step of combining a non-distortion specific plurality of parameters with said distortion specific quality measure to provide said quality measure.

6. A method according to claim 4 in which the samples represent speech transmitted over a telecommunications network, and in which the quality measure is representative of the quality of the speech perceived by an average user.

7. A computer readable medium carrying a computer program for implementing a method comprising:

dividing a database comprising a plurality of samples, each with an associated mean opinion score, into a plurality of distortion sets of samples according to a dominant distortion present in each sample; and training a distortion specific assessment handler for each distortion set, such that a fit between a distortion specific quality measure generated from a distortion specific plurality of parameters for a sample and the mean opinion score associated with said sample is optimized.

8. An apparatus for assessing speech quality of a sample in a telecommunications network comprising means for identifying a first dominant distortion type for the sample, the first dominant distortion type being selected from a plurality of possible distortion types;

a plurality of distortion specific assessment handlers each of said plurality of distortion specific assessment handlers being associated with a respective one of said plurality of possible distortion types for combining a distortion specific plurality of parameters to provide a distortion specific quality measure for the sample;

means for selecting a selected distortion specific assessment handler in dependence upon said first dominant distortion type from said plurality of distortion specific assessment handlers; and means for generating a quality measure in dependence upon the distortion specific quality measure; and, a computer-readable medium for storing said quality measure.

9. An apparatus according to claim 8, in which the generating means comprises means for combining a non-distortion specific plurality of parameters with said distortion specific quality measure to provide said quality measure.

10. An apparatus for training a quality assessment tool comprising means for dividing a database comprising a plurality of samples, each with an associated mean opinion score, into a plurality of distortion sets of samples according to a dominant distortion present in each sample; and means for training a distortion specific assessment handler for each distortion set, to provide an optimized fit between a distortion specific quality measure generated from a distortion specific plurality of parameters for a sample and the mean opinion score associated with said sample; and a computer-readable medium for storing said optimized fit.

11. An apparatus according to claim 10, further comprising means for training the quality assessment tool, such that a fit between a quality measure generated from a non-distortion specific plurality of parameters together with a distortion specific quality measure for a sample, and the mean opinion score associated with said sample, is optimized.

12. A method according to claim 2 in which the samples represent speech transmitted over a telecommunications network, and in which the quality measure is representative of the quality of the speech perceived by an average user.

13. A method according to claim 5 in which the samples represent speech transmitted over a telecommunications network, and in which the quality measure is representative of the quality of the speech perceived by an average user.

14. A computer readable medium as recited in claim 7, wherein said method further comprises:

training the quality assessment tool, such that a fit between a quality measure generated from a non-distortion specific plurality of parameters together with a distortion specific quality measure for a sample, and the mean opinion score associated with said sample is optimized.

15. A computer readable medium as recited in claim 7, wherein said samples represent speech transmitted over a telecommunications network, and said quality measure is representative of the quality of the speech perceived by an average user.

16. A computer readable medium carrying a computer program for implementing a method comprising:

wherein said method further:

identifying a first dominant distortion type for a sample, the first dominant distortion type being selected from a plurality of possible distortion types;

selecting a first distortion specific assessment handler in dependence upon said first dominant distortion type from a plurality of distortion specific assessment handlers, each of said plurality of distortion specific assessment handlers being associated with a respective one of said plurality of possible distortion types;

using the first distortion specific assessment handler to combine a plurality of parameters specific to said first dominant distortion type to provide a distortion specific quality measure for the sample; and generating a quality measure in dependence upon the distortion specific quality measure.

* * * * *